United States Patent [19]

Colin

[11] 4,073,217

[45] Feb. 14, 1978

[54] DEVICE ENABLING THE IMMOBILIZING OF A PISTON IN ITS CYLINDER

[75] Inventor: Jean-Paul Colin, Saint-Sebastien, France

[73] Assignee: Ste Anonyme dite: Ateliers et Chantiers de Bretagne - A CB, Nantes, France

[21] Appl. No.: 710,991

[22] Filed: Aug. 2, 1976

[30] Foreign Application Priority Data

Aug. 12, 1975 France ..... 75 25038

[51] Int. Cl.[2] ..... F15B 15/26

[52] U.S. Cl. ..... 92/27; 91/44; 92/86.5; 188/67; 188/300

[58] Field of Search ..... 92/19, 24, 27, 28, 18, 92/23, 86.5; 91/41, 44, 45; 188/67, 300

[56] References Cited

U.S. PATENT DOCUMENTS

| | | | |
|---|---|---|---|
| 2,815,736 | 12/1957 | Wright | 92/24 |
| 2,971,496 | 2/1961 | Geyer | 92/19 |
| 3,096,075 | 7/1963 | Brown | 188/67 |
| 3,150,570 | 9/1964 | Johnson | 92/28 |
| 3,150,571 | 9/1964 | Frassetto | 92/28 |
| 3,420,144 | 1/1969 | Berry | 92/24 |
| 3,470,793 | 10/1969 | Hanchen | 92/24 |
| 3,597,016 | 8/1971 | Gachot | 92/27 |
| 3,995,534 | 12/1976 | Rastetter | 92/27 |

FOREIGN PATENT DOCUMENTS

| | | | |
|---|---|---|---|
| 2,459,610 | 10/1975 | Germany | 92/23 |
| 866,757 | 7/1949 | Germany | 92/24 |

*Primary Examiner*—Martin P. Schwadron
*Assistant Examiner*—Abraham Hershkovitz
*Attorney, Agent, or Firm*—Charles H. Lindrooth

[57] ABSTRACT

A hydraulically or pneumatically controlled device for locking a piston in the bore of its cylinder at any point of its stroke, comprises, mounted on the piston, fluid-tight seals, a series of wedges, and annular jacks incorporated in the piston. The wedges are arranged to move in translation parallel to the axis of the cylinder under the effect of the annular jacks so as to absorb the increase in the radial plays between the piston and the bore of the cylinder on its pressurization. This peripheral extension which is produced between the bottom of the cylinder on its intake side and the fluid-tight end seal of the piston spaced furthest from it, is followed, after the release of the lateral walls of the cylinder, by a retraction of the lateral walls of the cylinder acting on the outer surface of the wedges. The latter exert a grip on the piston thus effecting positive locking by binding of the cylinder and of the piston. The device is useful for stamping presses for immobilizing the plate, or plastics injection presses, as well as jacks for coupling devices between a barge and a tug.

5 Claims, 3 Drawing Figures

DEVICE ENABLING THE IMMOBILIZING OF A PISTON IN ITS CYLINDER

BACKGROUND OF THE INVENTION

1. Field of the Invention

The invention relates to devices for immobilising a piston in its cylinder and more particularly to the locking of a hydraulic jack at any point of its stroke.

2. Description of the Prior Art

There are known certain cases of the use of hydraulic jacks where the latter must maintain a considerable permanent stroke throughout an operation. This is the case, for example, of coupling devices between barges and tug-boats for navigation on the high seas. These two types of ships include special arrangements to ensure coupling by reason of the extremely high forces to which they will be subjected by bad weather. Thus, for example, the tug may be equipped at the front with oblique prismatic surfaces which become engaged under the thrust of the propellors in a cavity of conjugate shape situated at the rear of the barge, in the manner of a pyramidal wedge. To effect an absolutely rigid coupling at the end of insertion, the clamping force is ensured by a powerful hydraulic jack whose body is fast to the tug and whose piston rod end is fastened to the barge. This force must be maintained permanently throughout the duration of the journey. At the end of the operation, the force necessary to uncouple the barge and the tug will be higher by reason of the wedging forces created by the obliquity of the contact surfaces.

The maintenance of the clamping force during the period of coupling between the barge and the tug is indispensable and more particularly in bad weather. It was hence indispensable to effect the locking of the rod of the jack at the end of the operation of coupling the two ships. To this end, it is known that there exist already mechanical locking devices, among others that in which the end of the rod of the jack includes a screw element with interrupted threads engageable in a nut with an identical threading axially fast to the body of the jack, this engagement being made possible by placing face to face the smooth sectors of one of the parts with the threaded sectors of the other, the rigid linkage becoming positive by angularly limited rotation of the nut, which rotation is obtained by a hydraulic, pneumatic or electric motor.

In mechanical locking devices, the means for immobilising the rod are positioned so as to act as soon as the hydraulic clamping is achieved and the jack is no longer supplied. The rod of the jack is then more or less driven into its cylinder by reason of the variations in the relative positions of the barge and of the tug on each enclosure and especially because the barges can be different from one another. There must be hence taken into account these variations in position to establish the sizes of the locking members.

It has been proposed in U.S. Patent 3,150,571 of Frassetto et al to provide the end of a jack with a sleeve which is traversed by the rod of the jack with a frictional force such that this rod is immobilised. To unlock the jack, a fluid under pressure is introduced into the sleeve so as to produce its elastic expansion and thus to eliminate the friction. This device is suitable for jacks which only have to undergo a small number of operations, since wear and fatigue of the metal reduce the gripping force. Moreover irregularities in the rod cause differences in the braking force.

OBJECTS AND GENERAL DESCRIPTION OF THE INVENTION

It is an object of the invention to provide a device which enables the locking of the piston in its cylinder at any point of its stroke, said device not being sensitive to wear and to irregularities of the surfaces concerned.

Other objects and advantages of the device according to the invention will become apparent from the description which follows.

According to the invention, there is provided a device which comprises, mounted on a conical portion of the piston, a series of wedges whose translation parallel to the axis of the cylinder absorbs the increase in radial plays between the piston and the bore of the cylinder caused by the peripheral extension of said cylinder on its pressurization. When the chamber of the cylinder is no longer supplied, the retraction of the walls is exerted on the external lateral surface of the wedges, which act themselves on the piston, thus producing positive locking by binding of the cylinder and of the piston.

BRIEF DESCRIPTION OF THE DRAWINGS

A preferred embodiment of the device according to the invention is described below and is shown in the accompanying drawings purely by way of illustrative but non-limiting example.

In the drawings.

DESCRIPTION OF A PREFERRED EMBODIMENT

Figure 1:
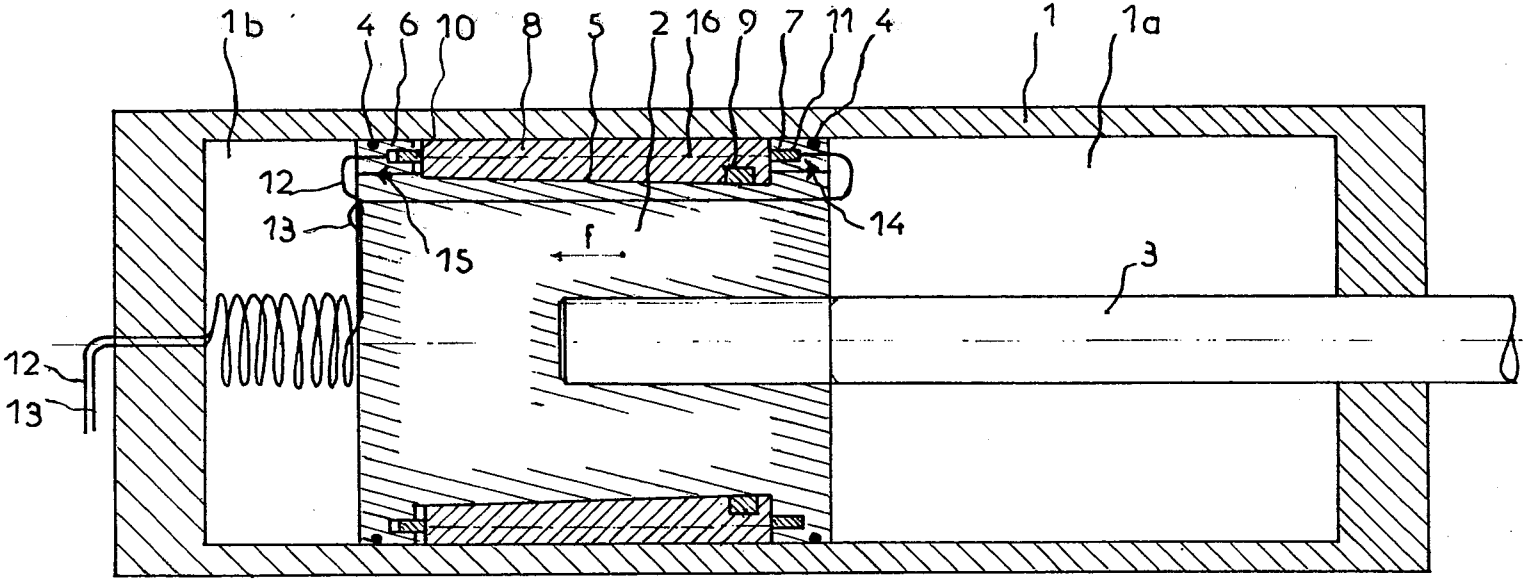
FIG. 1 shows a longitudinal section of one embodiment of a hydraulic jack according to the invention in unenergised position.
Figure 2:
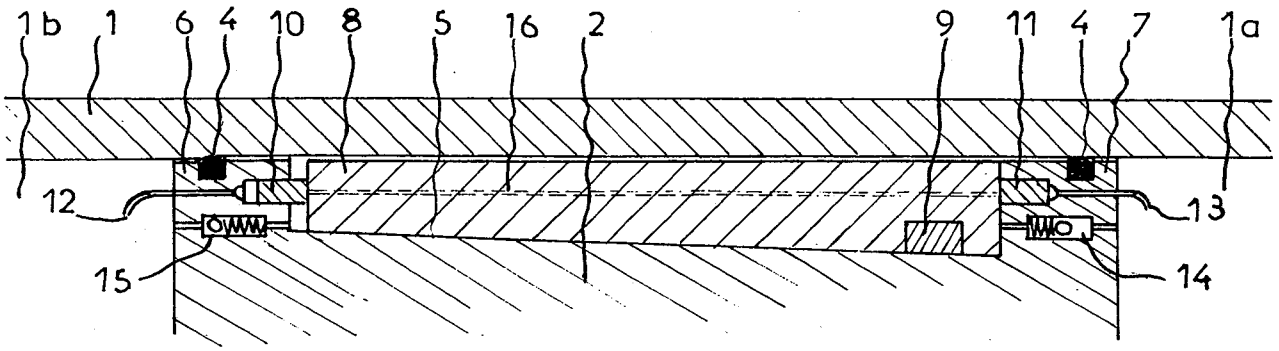
FIG. 2 shows a partial sectional view of the piston and of the cylinder in the course of pressurization of the embodiment of FIG. 1.
Figure 3:
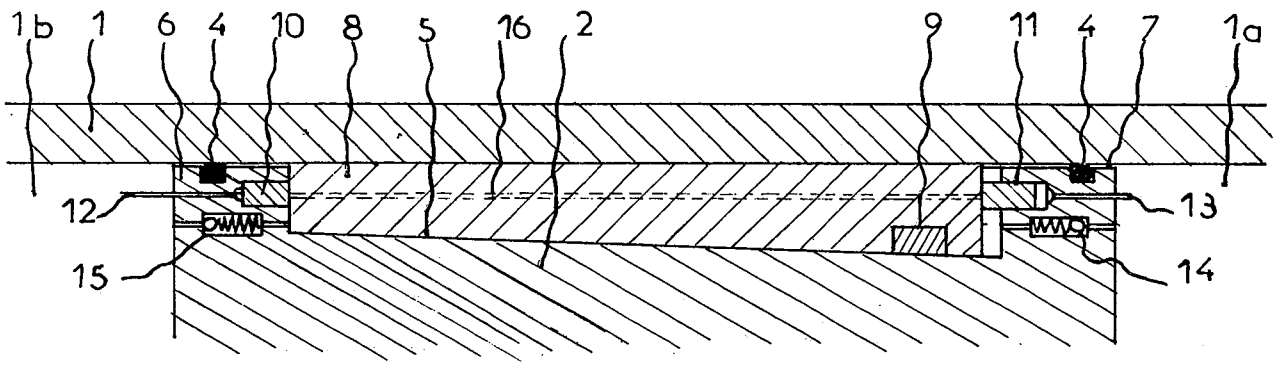
FIG. 3 shows the same partial sectional view as FIG. 2, the wedges having effected the translation necessary to absorb the radial plays.

In the body of the cylinder 1, slides piston 2 fast to the piston rod 3. Seals 4 ensure fluid-tightness with the bore of the cylinder at each end of the piston. The piston includes in its central portion a frustoconic machining 5 limited in length by end shoulders 6 and 7 each bearing a fluid-tight seal 4. On this frustoconic machining are mounted wedges 8 connected together by means of a circular ring 9 which ensures longitudinal linking between all the wedges. This ring is adjusted on the piston so that it can only move under the effect of frictional forces of the piston in the cylinder, but it can, on the other hand, effect a translation under the action of annular jacks incorporated with the piston. The group of these wedges constitutes a cylindrical ring of external diameter equal to that of the bore of the cylinder and of the frustoconic bore of a taper equal to the machining 5 of the piston and of a length such that it can effect the necessary longitudinal plays for sufficient translation between the shoulders 6 and 7 of the piston.

This translation parallel to the axis of the cylinder is produced in one direction or the other by one of the two annular jacks 10 or 11 mounted in each shouldered end 6 and 7 of the piston. These jacks are supplied through flexible connectors 12 and 13 the spiral winding of which at the bottom of the cylinder permits their extension in the course of the movements of the piston.

Pressurizing of the chambers 1*a* and 1*b* is effected in the usual manner for equipment of this type. For example, reference is made to Frassetto et al U.S. Pat. No. 3,150,571. FIGS. 1 and 10 show suitable systems for pressurizing a cylinder on one or the other side of a piston of the general kind referred to.

Upon pressurization of the chamber 1*a*, the zone in which this pressure is exerted on the walls of the cylinder extends from the bottom of this cylinder on the rod side to the fluid-tight seal 4 of the shoulder 6. To this end the fluid under pressure is introduced between the shoulders 6 and 7 through a check valve 14 of the ball type, for example housed in the shoulder 7.

In the same way, pressurization of the chamber 1*b* the zone of influence on the walls of the cylinder extends from the bottom of the cylinder on the side opposite the rod, to the fluid-tight seal 4 of the shoulder 7, the pressurized fluid being introduced between the two shoulders 6 and 7 through a check valve 15 housed in the shoulder 6. In one or other case the pressurized fluid flows in longitudinal grooves or slots 16 formed in the radiating adjacent surfaces of the wedges. The pressurization of the cylinder causes its radial extension in the above-defined zone.

The operation of locking the piston in the desired position consists of supplying the annular jack 11 with pressure so as to cause the translational movement of the group of wedges 8 along the arrow *f*, until their cylindrical outer surface comes into contact with the bore of the cylinder thus absorbing the operational play and the variation of the diametric size of the cylinder due to the pressurization of the latter.

At the moment of release of pressure in the cylinder, the cylinder walls retracts and produce a gripping on the group of wedges, which transmits this gripping force on to the body of the piston producing a rigid linkage by binding of the cylinder and of the piston.

To free the piston again, it suffices to restore pressure to the cylinder and to supply the annular jack 10 with pressure so that the wedges can effect by translation a return to the original position as soon as the peripheral extension of the cylinder is sufficient to free the wedges and the piston. This original position of the wedges corresponds with that which enables the necessary operational plays on normal sliding of the piston in its cylinder.

In summary, when the cylinder is pressurized, the wedges may be moved by the annular jacks along the inclined surface portion until the outer surface comes in contact with the bore of the cylinder. At this point, locking is effected by release of the pressure in the cylinder. To unlock, the cylinder is repressurized and the annular jacks are used to move the wedges in the opposite direction along the inclined portion of the piston until the piston is freed for movement within the cylinder. The piston may be locked at any desired position within the cylinder and will resist a force applied in either direction although it is more resistive to force applied toward the right as viewed in the drawings than to the left.

The invention is not limited to the embodiment described, but it encompasses all possible modifications provided that the latter are not in conflict with the scope of each of the claims appended to the present description.

Thus, by way of modification and without departing from the scope of the invention, the wedges can slide on the inclined surfaces of a pyramidal machining effected on the piston.

The device according to the invention may be used in all cases where it is necessary to immobilise a piston rigidly in its cylinder and at any point of its stroke.

Thus advantageous applications can be made in jacks equipping presses in order to immobilise the plate at a given height or indeed again on injection presses for plastics materials in order to reduce the uncoupling stroke of the upper and lower constituent parts of the moulds. Another advantageous application of the invention is to jacks used in coupling devices between a barge and a pusher tug-boat.

I claim:

1. A fluid controlled device comprising a cylinder, a piston moveable in said cylinder under fluid pressure and defining therewith two expansible chambers, said piston having an inclining peripheral surface portion intermediate its ends, wedge means mounted on the inclined peripheral surface portion for movement along said surface, annular jacks carried by said piston, said jacks being operatively connected to said wedge means for exerting forces thereon for selective movement of the wedge means towards one or the other ends of said inclining surface portion, means communicating fluid pressure in at least one of the chambers to the piston and cylinder interface, said cylinder having wall portions subject to radial expansion when the cylinder is under pressure to create a clearance between the piston and cylinder wall portions, said wedge means being moveable under the influence of said jacks along the inclined peripheral portion of the piston to a position in which they are radially displaced by an amount essentially equal to the maximum radial clearance between the piston and the wall of said cylinder caused by radial expansion of said cylinder when the cylinder is under pressure.

2. A device according to claim 1 wherein said inclined portion comprises a frustoconic portion of the piston and wherein said wedge means comprises a plurality of wedges distributed circularly around the frustoconic portion, and a circular ring interconnecting said wedges for fixing the wedges relative to one another for movement as a unit under the influence of said jacks.

3. A device according to claim 2, wherein a cylindrical shoulder at each end of the frustoconic portion forms a fluid-tight seal with the bore of the cylinder.

4. A device according to claim 3, wherein said annular jacks are housed in each of the cylindrical shoulders of the piston, conduits for pressurized fluid extending internally of the cylinder for supplying fluid to said annular jacks in a spiral winding in order to permit their extension in the course of movement of the piston.

5. A device according to claim 3, wherein the communicating means comprises a check valve housed in each of the end shoulders of the piston, longitudinal passageways formed in the radiating contiguous surfaces of the wedges, said check valves and said passageways cooperating to provide communication from the chamber of the cylinder under pressure to the portion of the cylinder between the fluid-tight seals.

* * * * *